US009190071B2

(12) United States Patent
Butts et al.

(10) Patent No.: US 9,190,071 B2
(45) Date of Patent: Nov. 17, 2015

(54) NOISE SUPPRESSION DEVICE, SYSTEM, AND METHOD

(75) Inventors: Donald J. Butts, Milford, CT (US); William A. Welsh, North Haven, CT (US); Thomas A. Millott, Milford, CT (US); Stuart K. Drost, Shelton, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 343 days.

(21) Appl. No.: 13/618,761

(22) Filed: Sep. 14, 2012

(65) Prior Publication Data

US 2014/0079234 A1 Mar. 20, 2014

(51) Int. Cl.

| | |
|---|---|
| ***G10K 11/178*** | (2006.01) |
| ***G10L 21/0208*** | (2013.01) |
| *G10L 21/0216* | (2013.01) |

(52) U.S. Cl.

CPC .... *G10L 21/0208* (2013.01); *G10K 2210/1081* (2013.01); *G10K 2210/121* (2013.01); *G10K 2210/128* (2013.01); *G10K 2210/1281* (2013.01); *G10L 21/0216* (2013.01); *G10L 2021/02085* (2013.01)

(58) Field of Classification Search

None

See application file for complete search history.

(56) References Cited

U.S. PATENT DOCUMENTS

| | | | | |
|---|---|---|---|---|
| 4,689,821 | A | 8/1987 | Salikuddin et al. | |
| 4,972,491 | A | 11/1990 | Wilcox, Jr. | |
| 4,985,925 | A | 1/1991 | Langberg et al. | |
| 5,251,263 | A | 10/1993 | Andrea et al. | |
| 6,278,786 | B1 | 8/2001 | McIntosh | |
| 7,224,807 | B2 | 5/2007 | Welsh et al. | |
| 2009/0060217 | A1 * | 3/2009 | Sakamoto et al. | 381/71.4 |
| 2009/0080670 | A1 | 3/2009 | Solbeck et al. | |
| 2010/0105447 | A1 | 4/2010 | Sibbald et al. | |
| 2010/0189277 | A1 | 7/2010 | Birgersson | |
| 2011/0026723 | A1 * | 2/2011 | Inoue | 381/71.4 |
| 2011/0261970 | A1 * | 10/2011 | Hamelink et al. | 381/71.4 |
| 2013/0056581 | A1 * | 3/2013 | Sparks | 244/1 N |

FOREIGN PATENT DOCUMENTS

WO 2006003618 A1 1/2006

* cited by examiner

*Primary Examiner* — Regina N Holder

(74) *Attorney, Agent, or Firm* — Cantor Colburn LLP

(57) ABSTRACT

A noise-suppression assembly of a mechanical drive system having a rotational frequency includes an audio filter unit configured to receive a first audio signal and a timing signal of the mechanical drive system. The audio filter unit generates a noise-cancellation signal based on a frequency of the timing signal to suppress a noise generated by the mechanical drive system and to apply the noise-cancellation signal to the first audio signal to produce a filtered first audio signal. The frequency of the timing signal is based on the rotational frequency of the mechanical drive system.

20 Claims, 6 Drawing Sheets

NOISE SUPPRESSION DEVICE, SYSTEM, AND METHOD

BACKGROUND OF THE INVENTION

Embodiments of the present invention pertain to the art of noise suppression, and in particular to the suppression of noise from mechanical drive system in an audio signal.

Vehicles and structures having ambient noise may require an audio system to transmit audio signals from one person to another within the vehicle or structure. For example, in a helicopter, airplane, or ground vehicle, one or more occupants may have a headset including speakers and a microphone. The occupants talk into the microphone to communicate with other occupants, and the communication is received by the speakers of one or more occupants. Examples of speakers include earphones and earplugs.

However, when an occupant transmits an audio signal from the microphone, the ambient noise of the vehicle or structure is also transmitted, inhibiting communication between the occupants of the vehicle or structure.

BRIEF DESCRIPTION OF THE INVENTION

Disclosed is a noise-suppression assembly of a mechanical drive system having a rotational frequency. The noise suppression assembly includes an audio filter unit configured to receive a first audio signal and a timing signal of the mechanical drive system. The audio filter unit is configured to generate a noise-cancellation signal based on a frequency of the timing signal, where the frequency is based on the rotational frequency of the mechanical drive system. The noise-cancellation signal is configured to suppress a noise generated by the mechanical drive system, and the audio filter unit is configured to apply the noise-cancellation signal to the first audio signal to produce a filtered first audio signal.

Also disclosed is a noise-suppression system, comprising a mechanical drive system having a rotational frequency, a timing signal generation unit to generate a timing signal to control the mechanical drive system, and an audio system including an audio filter unit. The audio filter unit is configured to receive a first audio signal and the timing signal and to generate a noise-cancellation signal corresponding to a frequency of the timing signal to suppress noise from the mechanical drive system to generate a first filtered audio signal.

Also disclosed is a method of suppressing noise in a mechanical drive system having a rotational frequency. The method includes receiving a first audio signal, receiving a timing signal of the mechanical drive system, determining a frequency of the timing signal, and generating a noise-suppression signal based on the frequency of the timing signal. The method further includes applying the noise-suppression signal to the first audio signal to suppress a noise generated by the mechanical drive system.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus is presented herein by way of example and not limitation with reference to the Figures.

Figure 1:
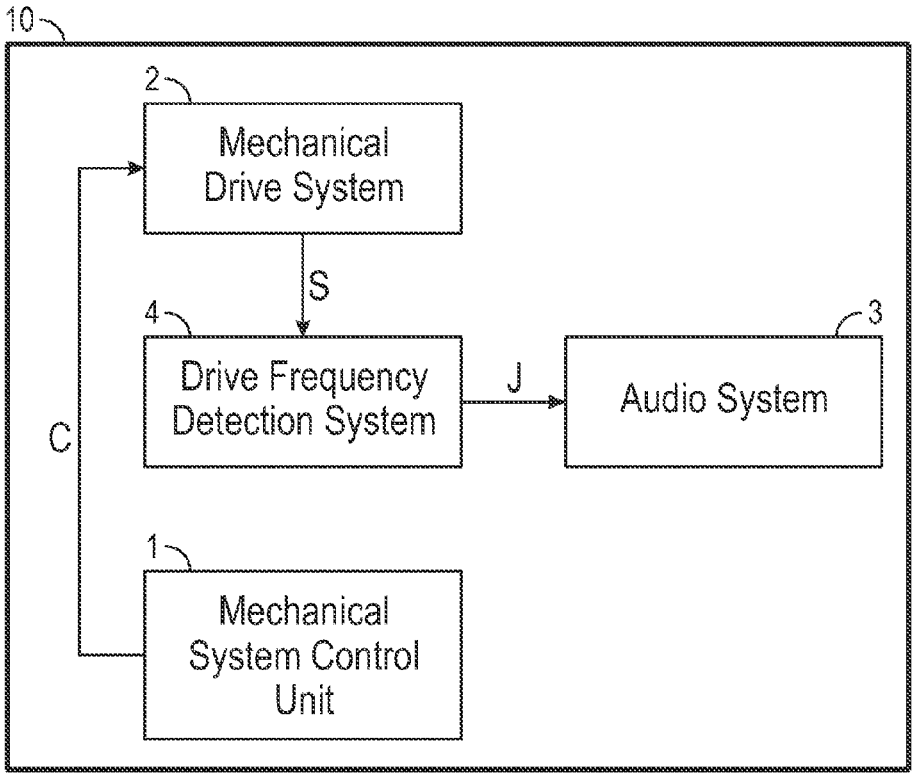
FIG. 1 is a block diagram of a noise suppression system according to an embodiment of the present invention.

FIG. 1 illustrates a noise-suppression system according to an embodiment of the present invention. The noise-suppression system includes a mechanical system control unit 1, a mechanical drive system 2, an audio system 3, and a drive frequency detection system 4 within an affected environment 10. The affected environment 10 may be a fixed structure or a vehicle. Examples of vehicles include helicopters, airplanes, automobiles, and boats. The affected environment 10 need not be entirely enclosed, but is rather defined in the present specification and claims as an environment affected by noise from the mechanical drive system 2. In one embodiment, the mechanical drive system 2 has a rotational frequency and emits noise based on the rotational frequency. The mechanical system control unit 1 may include electronics to generate a mechanical drive system control signal C ("control signal C") to control the mechanical drive system 2. The control signal C may be a control signal that controls the operation of the mechanical drive system 2. The control signal C may have a predetermined frequency that is determined by the mechanical system control unit 1, so that the operation of at least part of the mechanical drive system 2 is based on the predetermined frequency of the control signal C.

The mechanical system control unit 1 may include user controls, such as a joystick, steering wheel, levers, buttons, keyboard or other controls to allow a user to control the mechanical drive system 2. The mechanical system control unit 1 may also include a controller including a processor to receive the physical input from the user controls and to generate the control signal C based on the physical input. According to one embodiment, the mechanical system control unit 1 may include data storage to store programs to control the control signal C. In other words, the control signal C may not be affected by user input at the mechanical system control unit 1, but may be predetermined based on values of data stored in memory. In another embodiment, the control signal C is generated based on a combination of a user input to user controls and values of data, such as algorithms, stored in memory.

The mechanical drive system 2 may be driven by the control signal C. Sensors may detect a frequency generated by the mechanical drive system to generate sensor signals S. The frequency may correspond to a rotation rate of a rotor in the mechanical drive system, for example. The drive frequency detection system 4 may analyze the sensor signals S to output a timing signal J corresponding to the detected rotational frequency of the mechanical drive system 2.

In embodiments of the present invention, the timing signal J is output to the audio system 3. The audio system 3 includes one or more speakers located within or near the affected environment 10. As discussed in further detail below, the timing signal J is used by the audio system 3 to filter out noise of the mechanical drive system 2 from audio signals output from the audio system 3.

Figure 2:
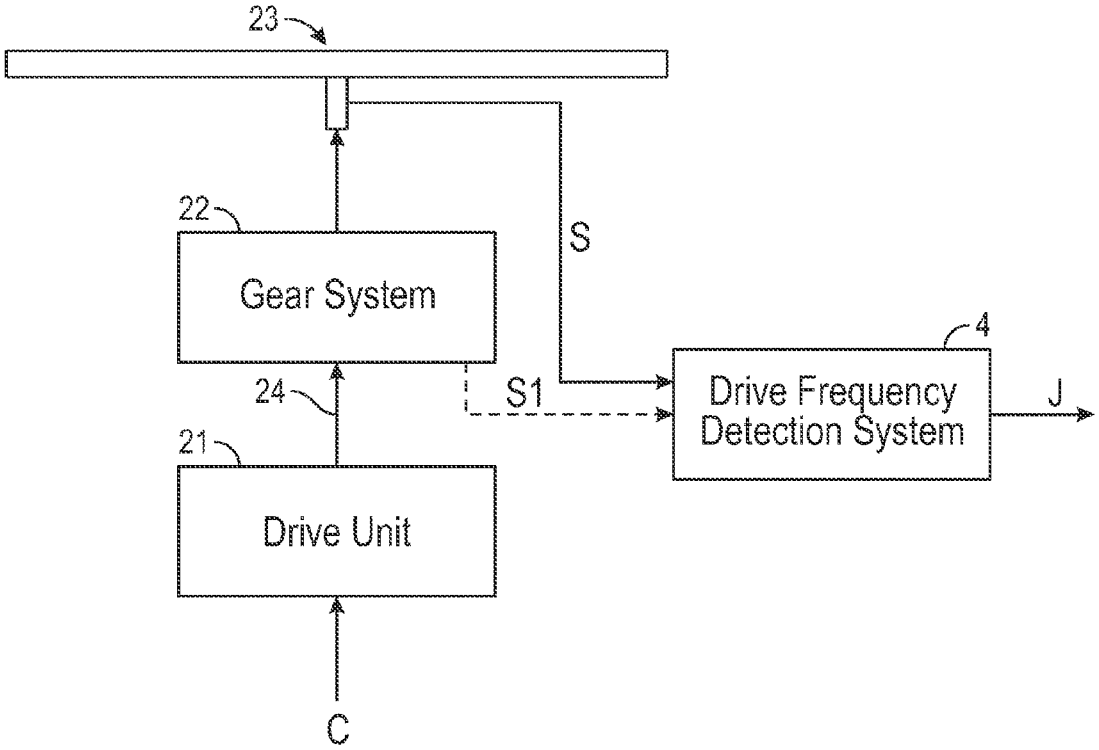
FIG. 2 illustrates a mechanical drive system according to one embodiment.

FIG. 2 illustrates an example of a mechanical drive system 2 according to one embodiment of the present invention. In the example of FIG. 2, the mechanical drive system 2 is a rotor system. The control signal C is input to a drive unit 21 to generate a mechanical force. The drive unit 21 may be an engine that rotates a shaft, a motor, or any other device to transform a control signal C to a mechanical force.

The drive unit 21 may be connected to a gear system 22. The gear system 22 includes one or more gears connected to a shaft 24 from the drive unit 22 to obtain a predetermined rotation ratio with respect to the shaft 24 from the drive unit 22. In the embodiment of FIG. 2, the affected environment 10 is a helicopter, and the gear system 22 is connected to a rotor 23 including blades. The drive unit 21 receives the control signal C from the mechanical system control unit 1, provides a corresponding level of fuel or power to an engine of the drive unit 21 to rotate a shaft 24 at a predetermined speed. The gear system 22 connects the rotor blades 23 to the shaft 24 from the drive unit 21 to cause the rotor 23 to rotate at a predetermined ratio with respect to the rotation rate of the shaft 24.

Sensors located on the rotor 23 generate sensor signals S that are output to the drive frequency detection system 4. The drive frequency detection system 4 analyzes the frequency of the sensor signals S, and generates a timing signal J based on the sensed frequency. In embodiments of the present disclosure, the drive frequency detection system 4 may detect the rotational frequency of the rotor 23 based on characteristics of signals output by the sensors, such as a threshold output level. For example, in an embodiment in which the sensor is a proximity sensor, the drive frequency detection system 4 may detect a threshold sensor signal S level corresponding to a position of the rotor 23 relative to fixed position. Analyzing multiple threshold sensor signal S levels over time may provide rotational frequency information of the rotor 23. In some embodiments, the drive frequency detection system 4 may include hardware or software filters to filter the sensor signals S. For example, upon calculating a rotational frequency based on the sensor signals S, the drive frequency detection system may discard threshold output readings that vary from the detected frequency by more than a predetermined amount.

In one embodiment, the drive frequency detection system 4 detects a frequency of the rotor 23 and calculates harmonic frequencies of the gear system 22 based on known physical dimensions, such as gear ratios, of the gears in the gear system 22. The drive frequency detection system 4 may then generate the timing signal J, which may include multiple timing signals, based on a combination of the frequency generated by the rotor 23 and the calculated harmonic frequencies. In yet another embodiment, the drive frequency detection system 4 detects a frequency of the gear system 22 and calculates a frequency of the rotor 23 based on known physical relationships, such as gear ratios, between the gear system 22 and the rotor 23.

In one example, the drive frequency detection system may detect a frequency of the rotor 23 of 3 Hz. Then, to determine the shaft frequency for each gear, the rotation frequency of the rotor 23 is multiplied by the gear tooth ratio. For example, an input-to-output gear tooth ratio of 10 would result in an output gear shaft frequency of 30 Hz. The mesh frequency for each gear pair may be determined by multiplying the number of teeth of the gear by the output gear shaft frequency. In one embodiment, the mesh frequency corresponds to a first harmonic frequency. The drive frequency detection system 4 may generate additional harmonic frequencies by multiplying the gear mesh frequency by 2, 3, 4, etc. to correspond to any detected or pre-determined number of harmonic frequencies.

In one embodiment, the sensor signals S are generated by a contactor that produces a predetermined number of pulses per revolution of the rotor 23. As illustrated in FIG. 2, sensors may be positioned on the gear system 22 and the drive unit 21 instead of, or in addition to, the sensors on the rotor 23 to generate sensor signals S1 and S2, respectively. In one embodiment, the sensor signals S1 are generated by a proximity pickup sensor located on a gear of the gear system 22. The sensors may provide signals or pulses based on detecting the rotation of gears, rotors, or other rotating elements in the mechanical drive system 2, as opposed to signals based on a sound output by the mechanical drive system 2. In other words, in one embodiment, the sensors that are used to generate the timing signal J may exclude acoustical sensors that detect sound waves. For example, the sensors may include sensors to detect an absolute position of the rotor 23, a relative position of the rotor 23, or a rotation frequency of the rotor 23. In another embodiment, the timing signal J may be used in conjunction with acoustical sensors that detect sound waves to cancel mechanical drive system 2 noise in an audio system 3.

The drive unit 21 generates noise at a predetermined frequency that corresponds to the frequency of the timing signal J. For example, as the rotations per minute (rpm) of the rotor 23 increases, the frequency of the timing signal J increases. Likewise, as the rpm of the rotor 23 decreases, the frequency of the timing signal J decreases.

The sound produced by the drive unit 21 corresponds to the rpm of the drive unit 21, so the frequency of the sound produced by the drive unit 21 may be deduced based on the frequency of the timing signal J. The gear system 22 may generate noise at harmonic levels of the frequency of the drive unit 21 according to the dimensions of the gears. The rotor blades 23 may also generate noise at a frequency corresponding to the frequency of the timing signal J, and also corresponding to the number of blades of the rotor 23.

While FIG. 2 illustrates an embodiment including a gear system 22, in some embodiments, no gear system is included, and the drive unit 21 is directly connected to rotor 23. In addition, while FIG. 2 illustrates blades connected to the rotor 23, any type of device may be driven, including fan blades, wheels, belts, pistons, ignition chambers, starter-generators, or any other type of motive device.

Figure 3:
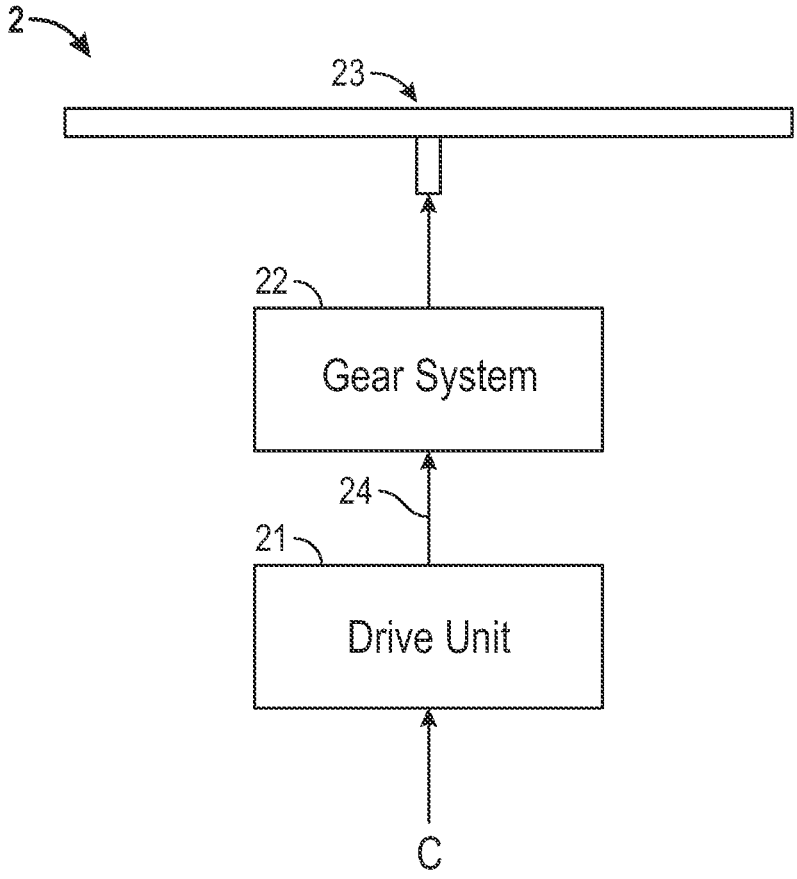
FIG. 3 a mechanical drive system according to one embodiment.

Referring to FIG. 3, the control signal C may be input to the drive unit 21 to control the drive unit 21. As discussed above, the drive unit 21 may be an engine that rotates a shaft, a motor, or any other device to transform a control signal C to a mechanical force. The drive unit 21 may drive the gear system 22, which may in turn drive the rotor 23. In the embodiment illustrated in FIG. 3, the rotor 23 includes blades, such as in the rotor 23 of a helicopter. However, embodiments of the present invention include any type of mechanical system that generates a noise at a predetermined frequency.

In embodiments of the present disclosure, a timing signal J is generated by a timing signal generation unit, such as the drive frequency detection system 4 illustrated in FIG. 1. The timing signal J is output to the audio system 3 to improve audio performance by compensating for noise generated by the mechanical drive system 2.

Figure 4:
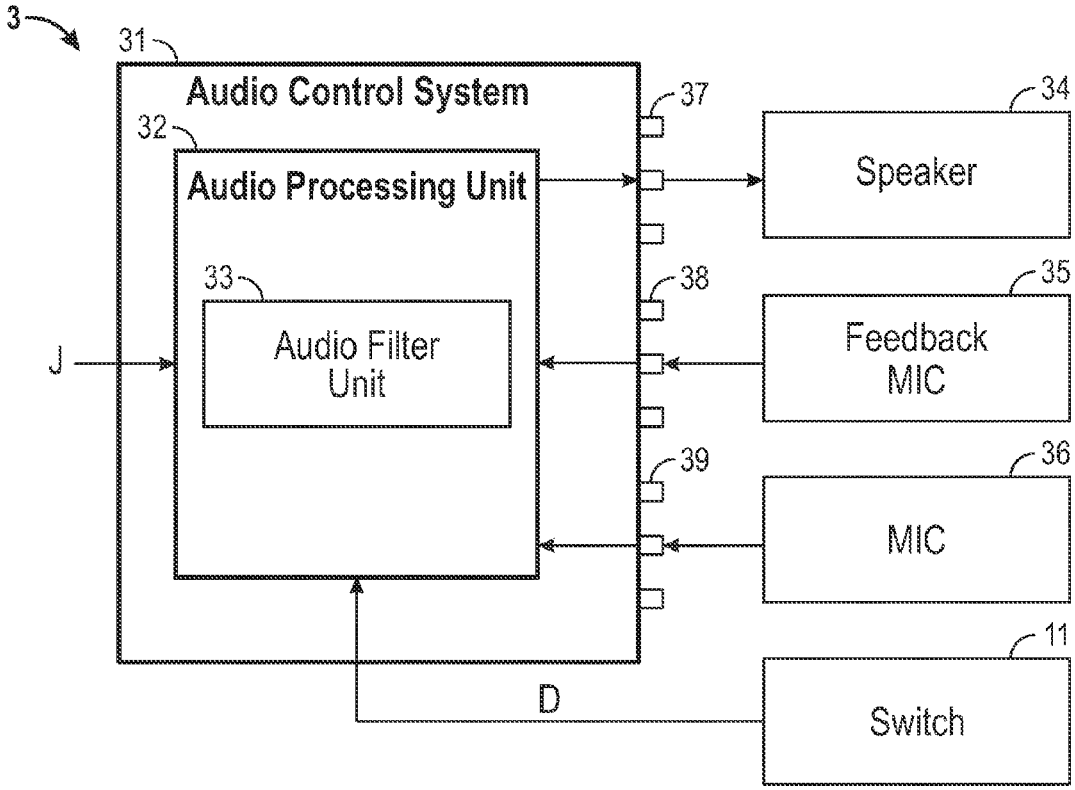
FIG. 4 illustrates an audio system according to one embodiment.

FIG. 4 illustrates an audio system 3 according to an embodiment of the present invention. The audio system 3 includes an audio control system 31 to receive audio input signals via ports 38 and 39, and to output audio signals via ports 37. The output ports 37 may be connected to one or more speakers 34. The input ports 38 may be connected to one or more feedback microphones 35, and the input ports 39 may be connected to one or more microphones 36. In one embodiment, the speaker 34 is a headset speaker, such as an earphone, an ear-bud, or an ear-cup. The feedback microphone 35 may be a microphone located adjacent to the earphone, ear-bud, or ear-cup, or inside the earphone or ear-cup, or may be located at any location around a head of a user, such as on a helmet. The microphone 36 may be a microphone of a headset to receive sounds from a user. For example, a user may speak words into the microphone 36, and the words may be transmitted to the one or more speakers 34.

The audio control system 31 may include an audio processing unit 32, and the audio processing unit 32 may include an audio filter unit to suppress unwanted noise from audio signals passing through the audio processing unit 32. The audio processing unit 32 may receive the audio input signals from the ports 38 and 39, and may determine whether to process and output one or more of the input audio signals to one or more of the audio output ports 37. The determination as to which audio signals should be transmitted to an audio output port 37, and which audio output port 37 should receive an audio signal may be made based on one or more control signals, such as control signals from a computer or processor or from switches 11 pressed by a user.

In one embodiment, a user presses a switch 11, which transmits a control signal D to the audio processing unit. The switch 11 may indicate a particular recipient, or the switch 11 may merely indicate that the audio signal should be output to each output port 37. In one embodiment, multiple switches 11 correspond to respective audio output ports 37. In one embodiment, the switch 11 is a lever or button, although in other embodiments, the switch 11 is a key of a keyboard, or any other selection apparatus. In yet another embodiment, the switch 11 is an electronic program stored in memory and executed by a processor. The program may detect when a user speaks into the microphone 36, and may automatically output the audio signal from the microphone 36 to one or more of the audio output ports 37 when the user speech is detected.

In alternative embodiments, the audio processing unit 32 may include memory, and may record audio signals input from one or more microphones 36. The recording may be controlled by the switch 11, or the recording may be continuous, and the switch 11 may control an output of the audio signal to the audio output ports 37.

In one embodiment, the audio signal input from the microphone 36 is continuously run through the audio filter unit, regardless of whether the switch 11 is in an ON or OFF state. In this embodiment, although the audio signal is continuously run through the audio filter unit 33, the switch 11 may still control a switch to output the filtered audio signal to the audio output ports 37. In other words, although the audio signal from the microphone 36 is constantly run through the audio filter unit 33, the audio signal is not automatically output to the audio output units 37. By continuously running the audio signal through the audio filter unit 33 when the switch 11 is in both the ON and the OFF states, transients generated by the starting and stopping of algorithms inherent in the filtering methods of the signal filter 41 may be avoided.

The audio processing unit 32 includes an audio filter unit 33 to filter out undesired frequencies, bandwidths, or noises from the audio signals either input via the audio input ports 38 and 39 or output to the audio output ports 37. The timing signal J may be input to the audio filter unit 33 to provide one or more frequencies or frequency bandwidths to be removed from an audio signal.

Although only the audio filter unit 33 of the audio processing unit 32 is illustrated for the purposes of describing embodiments of the invention, the audio processing unit 32 may include additional features, including one or more processors, memory, and supporting logic, A/D converters, filters, inputs, and outputs to process and control the input and output of audio signals in the audio control system.

Although physical ports 37, 38, and 39 are illustrated, the speaker 34, feedback microphone 35, and microphone 36 may be connected wirelessly to the audio control system 31 via one or more wireless transmitters/receivers.

Figure 5:
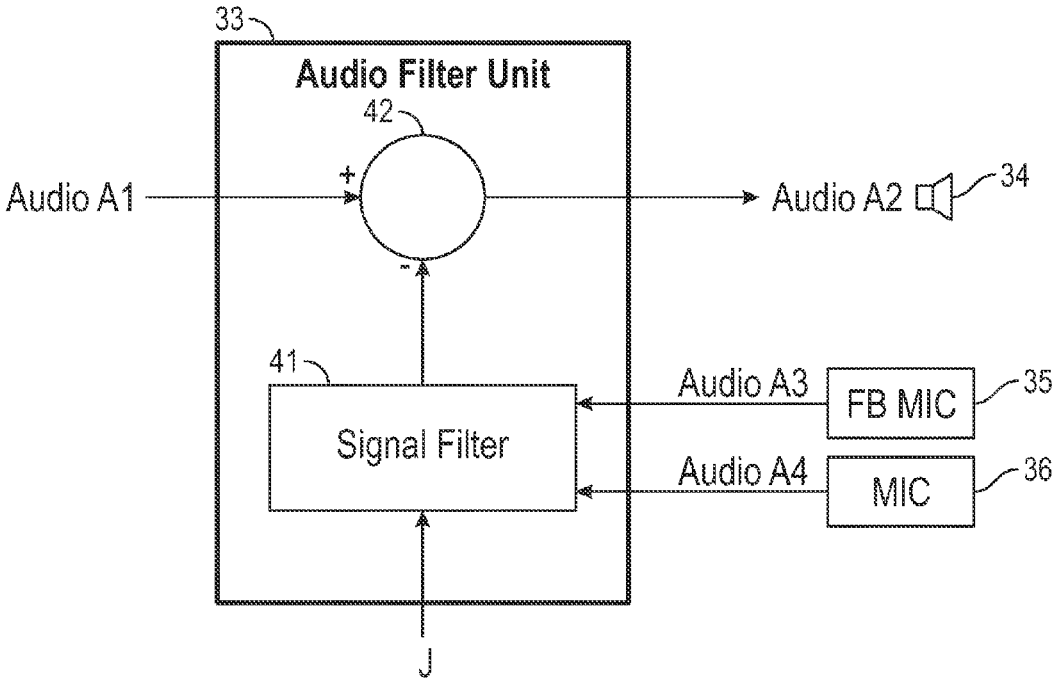
FIG. 5 illustrates an audio filter unit according to an embodiment of the invention.

FIG. 5 illustrates a functional diagram of the audio filter unit 33 according to one embodiment. The audio filter unit 33 includes at least one signal filter 41 and at least one adder 42. The signal filter 41 receives as inputs the timing signal J and at least one of the audio signal A3 input from a feedback microphone 35 and the audio signal A4 input from a microphone 36. The signal filter 41 determines a frequency of the timing signal J, determines a noise frequency of noise generated by the mechanical drive system 2 based on the timing signal J, and determines any harmonic frequencies of the noise generated by the mechanical drive system 2, corresponding, for example, to a gear system 22. The signal filter 41 then nullifies the frequencies, bandwidths, or noises corresponding to the determined noise frequency and/or harmonics corresponding to the frequency of the timing signal J from the audio signals A3 and A4.

In one embodiment, the signal filter 41 determines harmonic frequencies by multiplying and dividing the timing signal J by ratios corresponding to known physical dimensions of components in the mechanical drive system 2. For example, in an embodiment in which the timing signal J corresponds to a rotational frequency of a rotor 23 connected to a gear system 22, the signal filter 41 may retrieve from memory known gear ratios and may multiply the rotational frequency of the rotor 23, as measured by the timing signal J, by ratios based on the known physical gear ratios of the gear system 22. Conversely, in an embodiment in which the timing signal J corresponds to a rotational frequency of a gear in a gear system 22, the signal filter 41 may multiply the rotational frequency of the gear by a ratio based on the physical gear ratios of the gear system 22 to calculate the rotational frequency of the rotor 23. Both the base frequency and the harmonics may be used to cancel noise of from the mechanical drive system 2.

In one embodiment, the feedback microphone 35 is located outside an ear-bud, and the speaker 34 is located on the ear-bud, positioned in the ear of the user. The feedback microphone 35 detects the ambient noise and generates the audio signal A3. The signal filter 41 uses the timing signal J to generate a signal at a predetermined frequency or bandwidth to cancel out the ambient noise from the audio signal A3. The generated noise-cancelling signal is combined with the audio signal A1 to remove noise corresponding to the frequency of the timing signal J from the audio signal A1, resulting in an audio output signal A2.

In another embodiment, the feedback microphone 35 is located inside an earphone, such as an ear-cup. In such an embodiment, the audio signal A3 from the feedback microphone 35 includes ambient noise and sound from a speaker 34 located within the ear-cup. The signal filter 41 determines the frequency or bandwidth of the noise to be cancelled based on the timing signal J, generates a noise-cancelling signal based on the timing signal J and the audio signal A3, and combines the noise-cancelling signal with the audio signal A1 to output an audio signal A2.

In yet another embodiment, the signal filter receives an audio signal A4 from a microphone 36, such as a speaking microphone. The signal filter 41 removes the noise corresponding to the mechanical drive system 2 from the audio signal A4, and combines the filtered audio signal with the audio signal A1 to generate an audio signal A2.

Although the above embodiments illustrate an audio signal A2 being output to a speaker 34, according to some embodiments, the audio signal A2 may be stored or recorded in a recording medium, such as in memory.

Figure 6:
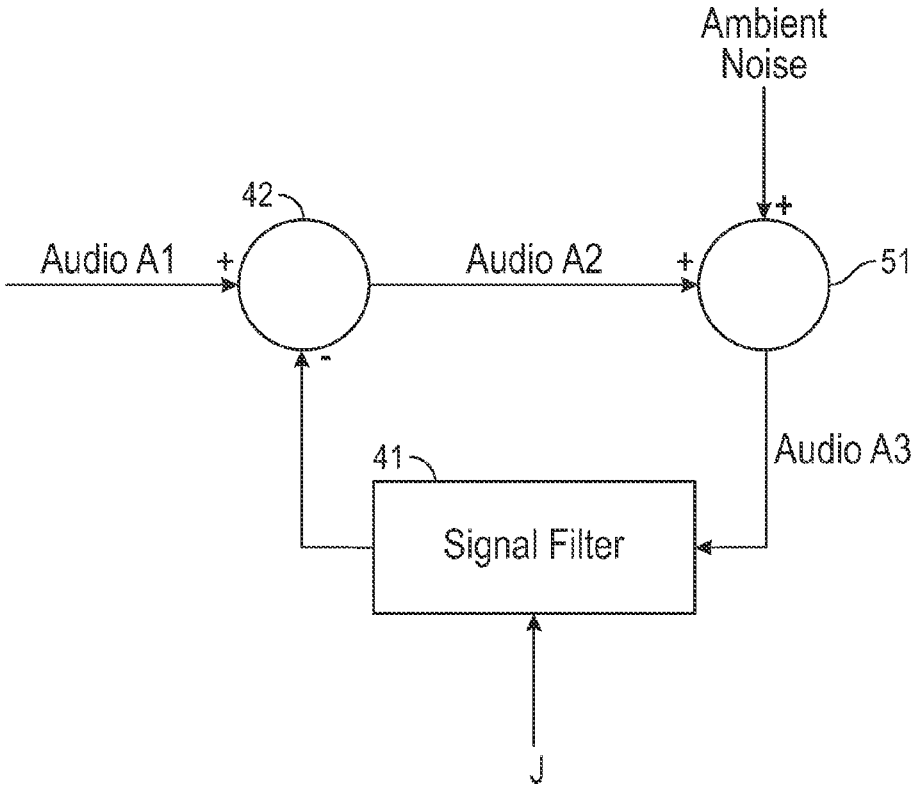
FIG. 6 illustrates an audio filter system according to one embodiment of the invention.

FIG. 6 is an operational diagram of the audio filter unit 33 according to one embodiment. In FIG. 6, node 51 represents a feedback mechanism, such as a feedback microphone 35. An audio signal A1 is generated in the audio processing unit 32 to be transmitted to audio output ports 37. The audio signal A1 is output via node 42 as audio signal A2 to a speaker 34. The output audio signal A2 is combined with ambient noise at node 51 to generate audio signal A3. For example, audio signal A2 and the ambient noise may be picked up by a feedback microphone 35. The ambient noise includes noise generated by a mechanical drive system 2 which corresponds to the timing signal J and may include the drive unit 21 and the gear system 22. In some embodiments, the drive system may further include a rotor 23, such as a rotor and blades of a helicopter. The drive unit 21, gear system 22, and rotor 23 may generate ambient noise having frequencies that correspond to the frequency of the timing signal J. For example, a relationship between a frequency of the timing signal J and the noise output from the drive unit 21, gear system 22, and rotor blades 23 may be represented by predetermined algorithms.

The audio signal A3 is input to the signal filter 41, where a cancellation signal is generated based on the frequency of the timing signal J, as well as any calculated harmonic frequencies. The cancellation signal is combined with the audio signal A1 at node 42 to cancel out the ambient noise generated by the mechanical drive system 2 corresponding to the timing signal J and any calculated harmonic frequencies.

Figure 7:
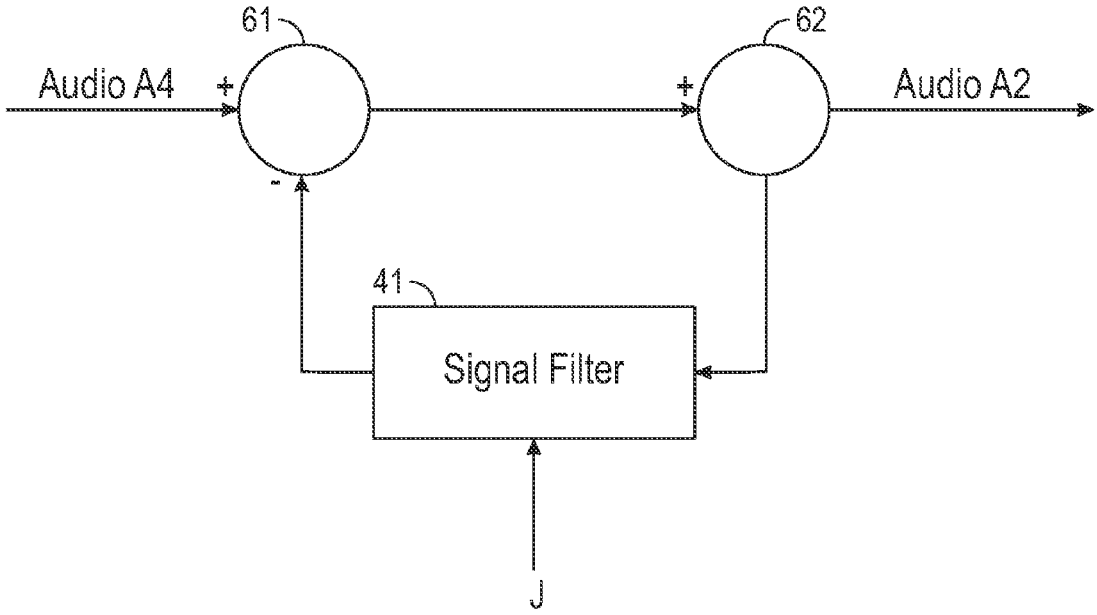
FIG. 7 illustrates an audio filter system according to another embodiment.

FIG. 7 illustrates a functional diagram of the audio filter unit 33 according to another embodiment. In FIG. 7, an audio signal A4 is received from a microphone 36. The audio signal A4 includes ambient noise generated by a mechanical drive system 2 which corresponds to the timing signal J and may include the drive unit 21 and the gear system 22. In some embodiments, the drive system may further include a rotor 23, such as a rotor and blades of a helicopter. The drive unit 21, gear system 22, and rotor 23 may generate ambient noise having frequencies that correspond to the frequency of the timing signal J, as discussed above.

At node 62, the audio signal A4 is input to the signal filter 41, and the signal filter 41 generates a cancellation signal to cancel the ambient noise corresponding to the timing signal J, as well as any calculated harmonic frequencies. The cancellation signal is combined with the audio signal A4 at node 61 to cancel out the ambient noise of the mechanical drive system 2 from the audio signal A4. The audio signal A4 may then be output to a speaker 34, recorder, or other audio processing system.

In the above embodiments, the signal filter 41 generates a cancellation signal based on a timing signal J that corresponds to a mechanical drive system 2. The cancellation signal may have a base frequency corresponding to the frequency of the timing signal J, and may further include harmonic frequencies corresponding to frequencies of the gear system 22, the rotor 23, or any other device connected to the drive unit 21 from which a frequency may be derived based on the timing signal J. For example, a wheel, fan or gears may generate ambient noise of a particular frequency that may be derived from the timing signal J based on known physical characteristics of the wheel, fan or gears.

In an embodiment in which the timing signal J is based on sensor signals S or S1, the harmonic frequencies and bandwidths of components in the drive unit 21, gears in the gear system 22, or blades of a rotor 23 may be derived based on known characteristics of the physical structure of the devices, such as a number and spacing of rotor blades, gear ratios, etc.

The signal filter 41 may employ known filter methods, such as comb filters and quasi-steady vibration control algorithms. The addition, subtraction, and splitting functions of the nodes 42, 51, 61 and 62 may be carried out by appropriate circuitry including wiring, transistors, comparators, processors, computer programs stored in memory to execute signal combination functions, and any other appropriate devices.

Figure 8:
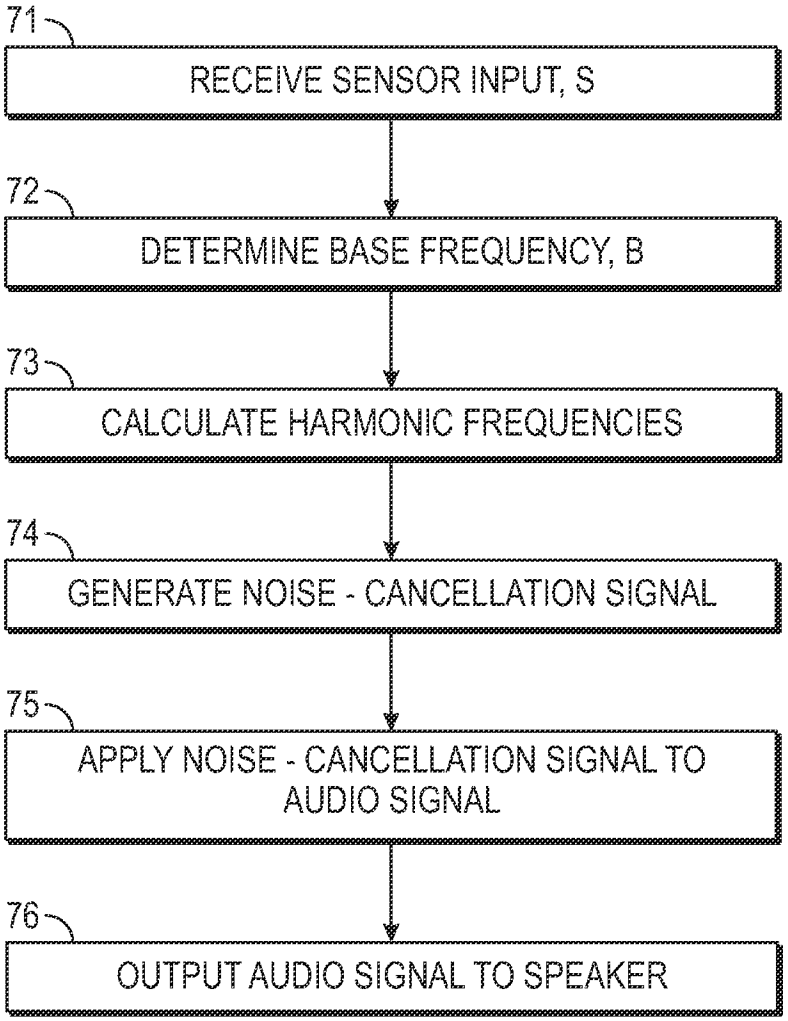
FIG. 8 is a flow diagram depicting a method of suppressing noise according to an embodiment of the present invention.

FIG. 8 is a flowchart illustrating a method of cancelling noise according to an embodiment of the present invention. In operation 71 sensor signal S is received. The sensor signal S may be received from any type of sensor, including a tachometer, a magnetic sensor, optical sensor, or any other type of sensor. The base frequency B of a noise generated by a mechanical drive system 2 is determined in operation 72 based on the sensor signal S. The base frequency B may be used to generate a timing signal J.

In operation 73, harmonics corresponding to the frequency of the timing signal J may be calculated. The harmonics may correspond to devices in the mechanical drive system 2, such as a gear system 22 and rotor 23. For example, if the drive unit 21 generates a noise at a base frequency B based on the rpm of the drive unit 21, then the gear system 22 may generate a noise at a another frequency that is a harmonic of the base frequency B according to gear ratios in the gear system 22. In other words, since the physical characteristics of components in a mechanical drive system 2 are known, such as shapes and dimensions of wheels, fans and gears, as well as gear ratios of gears to gears, gears to shafts, and gears to rotors, the physical dimensions may be used to calculate harmonic frequencies of the components of the mechanical drive system 2 based on a calculated rotational frequency of a rotor 23.

In operation 74, an audio signal is analyzed and frequency components of the audio signal that correspond to the timing signal J may be isolated to generate a noise-cancellation signal. The audio signal may be an audio signal from a feedback microphone 35 or from a microphone 36, such as a microphone into which an operator speaks. In some embodiments, the noise-cancellation signal is generated in real-time as the audio signal is being generated by the microphones 35 and 36. However, in alternative embodiments, the noise-cancellation signal could be applied to a pre-recorded signal that had been recorded in an environment in which a mechanical drive system 2 corresponding to the timing signal J was operated. The noise-cancellation signal may be calculated based on the timing signal, corresponding to a measured rotational frequency, as well as the harmonic frequencies calculated based on the timing signal J.

In operation 75 the noise cancellation signal having frequency components corresponding to the timing signal J, as well as any calculated harmonic frequencies, is subtracted from an audio signal that is to be output to a speaker or recorded. In operation 76, the audio signal having the noise corresponding to the mechanical drive system 2 cancelled out is output to the speaker 34.

According to the above method, a timing signal J that is generated based on sensors of a mechanical drive system 2 may be used to reduce noise in an audio system 3 in which the mechanical drive system 2 operates.

Figure 9:
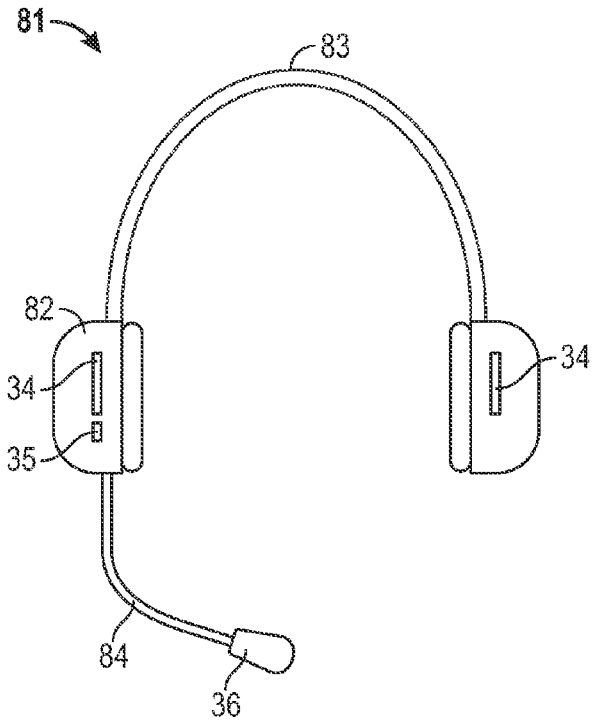
FIG. 9 illustrates an ear-cup configuration of speakers and a microphone according to one embodiment of the invention.

FIG. 9 illustrates a configuration of speakers 34 and microphones 35 and 36 according to one embodiment of the invention. A headset 81 includes ear-cups 82 and a band 83 connecting the ear-cups 82. Each ear-cup 82 includes inside a speaker 34 to emit noise to an ear of a user. At least one of the ear-cups 82 may further include a feedback microphone 35 to receive the sound from inside the ear-cup 82 and to transmit the sound to the audio control system 31. The audio signal generated by the feedback microphone 35 may be used, for example, to filter out undesired sounds.

The headset 81 also includes a microphone 36 configured to be positioned near the mouth of a user to receive the voice of the use. The microphone 36 is connected to the ear-cups 82, or to the band 83, by an extension portion 84.

In the embodiment illustrated in FIG. 9, the feedback microphone 35 and the microphone 36 may receive as inputs sound generated by the mechanical drive system 2. For example, when the headset 81 is used in a vehicle, such as a helicopter, the sound of the engine, motor, wheels, or rotor may be picked up by the feedback microphone 35 and the microphone 36. By implementing the above-described embodiments, the signals generated by the feedback microphone 35 and the microphone 36 may be used, along with the timing signal J, to suppress the noise of the mechanical drive system 2 in the audio signal that is output to the speakers 34.

Figure 10:
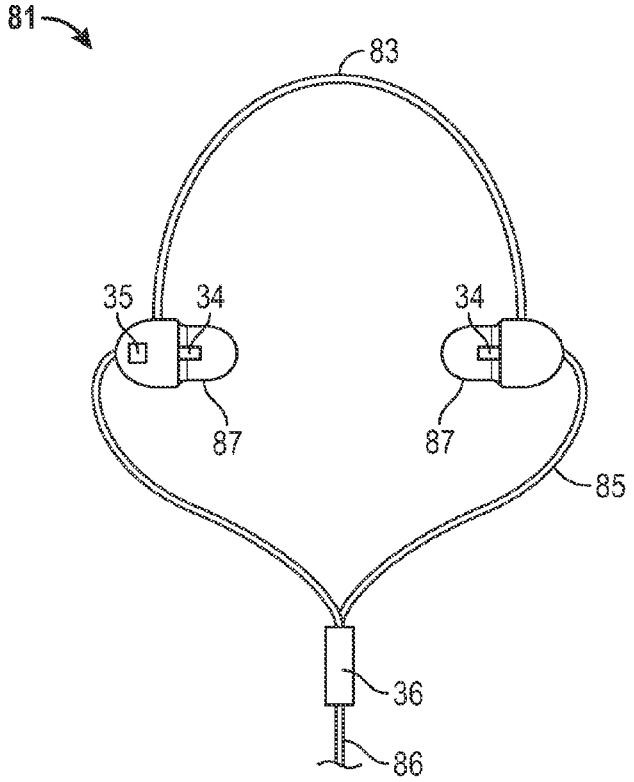
FIG. 10 illustrates an ear-bud configuration of speakers and a microphone according to one embodiment.

FIG. 10 illustrates a configuration of speakers 34 and microphones 35 and 36 according to another embodiment of the invention. The headset 81 includes ear-buds 87 positioned at least partially within a user's ear. The speakers 34 located inside the ear-buds 87 transmit sound to the user's ear. The ear-buds 87 may be mounted to a band 83, although according to one embodiment, no band is used to connect the ear-buds 87, and they are held in place by being snugly positioned in the ear. A portion of the ear-bud 87 located outside a user's ear may include a feedback microphone 35. The feedback microphone 35 picks up ambient sound around the ear-bud 87 including noise from the mechanical drive system 2.

Wires 85 may extend from the ear-buds 87 to a wire 86 connected to the audio control system 31. In one embodiment, the ear-buds 87 include wireless transmitters and no wires 85 or 87 are required to transmit audio signals to the audio control system 31. A microphone 36 may be positioned along one of the wires 85 and 86 to receive as an input a user's voice. In an alternative embodiment, an extension portion similar to the extension portion 84 of FIG. 9 is connected to the band 83 connecting the ear-buds 87.

The feedback microphone 35 and microphone 36 each pick up noise around the ear-buds 87, including noise generated by the mechanical drive system 2. By implementing the above-described embodiments, the signals generated by the feedback microphone 35 and the microphone 36 may be used, along with the timing signal J, to suppress the noise of the mechanical drive system 2 in the audio signal that is output to the speakers 34.

According to the above embodiments, information about the rotation of components in a mechanical drive system may be used to suppress noise from the mechanical drive system in an audio system. The information may be gathered by sensors other than acoustical sensors. For example, the information may be gathered by sensors that detect an absolute position, relative position, or rotation frequency of the components of the mechanical system. The information may include a timing signal that is based on the rpm of at least one component in the mechanical drive system, and may further include a bandwidth surrounding a base frequency and harmonics of the base frequency.

In the above-described embodiments, a timing signal generator generates a control signal Corresponding to a rotation rate of a component in a mechanical drive system. The timing signal generator may be a detection unit that receives sensor input from the mechanical drive system. The frequency of the control signal Corresponds to a frequency of noise generated by the mechanical drive system, and may be used to calculate a frequency, bandwidth, and harmonic frequencies to be removed from an audio signal in an audio system to generate a filtered audio signal.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A noise-suppression assembly of a mechanical drive system having a rotational frequency, the mechanical drive system including a rotor of a helicopter, the assembly comprising:

an audio filter unit configured to receive a first audio signal and a timing signal of the mechanical drive system, the audio filter unit configured to generate a noise-cancellation signal based on a frequency of the timing signal, said frequency based on the rotational frequency of the rotor, to suppress a noise generated by the mechanical drive system and to apply the noise-cancellation signal to the first audio signal to produce a filtered first audio signal, the frequency based on a signal obtained from at least one sensor located on the rotor, wherein the sensor is a proximity sensor configured to detect the position of the rotor relative to a fixed position.

2. The noise-suppression assembly of claim 1, wherein the audio filter unit is further configured to determine harmonic frequencies corresponding to the frequency of the timing signal and to generate the noise-cancellation signal based on the frequency of the timing signal and the harmonic frequencies.

3. The noise-suppression assembly of claim 2, wherein the audio filter unit is configured to determine the harmonic frequencies according to physical structures of gears in the mechanical drive system.

4. The noise-suppression assembly of claim 2, wherein the rotational frequency of the mechanical drive system corresponds to a gear in a gear system, and determining the harmonic frequencies includes determining a rotational frequency of a rotor.

5. The noise-suppression assembly of claim 1, further comprising a microphone, wherein the first audio signal is input from the microphone and the first audio signal includes the noise generated by the mechanical drive system.

6. The noise-suppression assembly of claim 5, wherein the audio filter unit is configured to generate the noise-cancellation signal based on the frequency of the timing signal and the noise in the first audio signal.

7. The noise-suppression assembly of claim 1, further comprising a speaker, wherein the filtered first audio signal is output to the speaker to generate a sound.

8. The noise-suppression assembly of claim 7, further comprising a feedback microphone configured to generate a second audio signal including the noise generated by the mechanical drive system, wherein the second audio signal is output from the feedback microphone to the audio filter unit, and the audio filter unit generates the noise-cancellation signal based on the frequency of the timing signal and the noise in the second audio signal.

9. A noise-suppression system, comprising:

a mechanical drive system of a helicopter including a rotor and having a rotational frequency;

at least one sensor located on the rotor, wherein the sensor is a proximity sensor configured to detect the position of the rotor relative to a fixed position;

a timing signal generator to generate a timing signal that corresponds to the rotational frequency of the rotor based on a signal from the at least one sensor; and an audio system including an audio filter unit configured to receive a first audio signal and the timing signal, the audio filter unit configured to generate a noise-cancellation signal corresponding to the rotational frequency of the rotor based on the timing signal to suppress noise from the mechanical drive system and to apply the noise-cancellation signal to the first audio signal to produce a filtered first audio signal.

10. The noise-suppression system of claim 9, wherein the audio system is configured to calculate one or more harmonic frequencies based on rotational ratios of mechanical components within the mechanical drive system to the rotational frequency, and to generate the noise-cancellation signal based on the rotational frequency and the one or more harmonic frequencies.

11. The noise-suppression system of claim 9, further comprising at least one headset including an earpiece including a speaker, and a mouthpiece including a first microphone.

12. The noise-suppression system of claim 11, wherein the filtered first audio signal is output to the speaker.

13. The noise-suppression system of claim 10, wherein the first audio signal is output from the first microphone and includes the noise from the mechanical drive system, and the audio filter unit is configured to generate the noise-cancellation signal based on the timing signal and the noise in the first audio signal.

14. The noise-suppression system of claim 10, further comprising a switch to output the first audio signal to the speaker when the switch is in an ON state and to prevent output of the first audio signal to the speaker when the switch is in an OFF state, wherein the audio filter unit is configured to generate the noise-cancellation signal continuously when the switch is in the ON state and when the switch is in the OFF state.

15. The noise-suppression system of claim 10, further comprising a feedback microphone located on the earpiece, the feedback microphone configured to output a second audio signal including the noise from the mechanical drive system, wherein the audio filter unit is configured to generate the noise-cancellation signal based on the frequency of the timing signal and the noise in the second audio signal.

16. A method of suppressing noise in a mechanical drive system having a rotational frequency, the mechanical drive system including a rotor of a helicopter, the method comprising:

receiving a first audio signal;

receiving a timing signal based on the rotational frequency of the rotor from at least one sensor located on the rotor, wherein the sensor is a proximity sensor configured to detect the position of the rotor relative to a fixed position;

determining a frequency of the timing signal;

generating a noise-suppression signal based on the frequency of the timing signal; and applying the noise-suppression signal to the first audio signal to produce a filtered first audio signal wherein a noise generated by the mechanical drive system in the first audio signal is suppressed, wherein the noise-suppression signal is continuously applied to the first audio signal such that transients generated by starting and stopping of the application of the noise-suppression signal are avoided.

17. The method of claim 16, further comprising determining one or more harmonic frequencies corresponding to mechanical components in the mechanical drive system, wherein the noise-suppression signal is generated based on the frequency of the timing signal and the one or more harmonic frequencies.

18. The method of claim 16, wherein the first audio signal is generated by a microphone and includes the noise generated by the mechanical drive system.

19. The method of claim 16, further comprising receiving a second audio signal from a feedback microphone, the second audio signal including the noise generated by the mechanical drive system, wherein the noise-suppression signal is generated based on the frequency of the timing signal and the noise in the second audio signal.

20. The method of claim 19, wherein the second audio signal includes a sound generated by the first audio signal and the noise generated by the mechanical drive system.

* * * * *